US005482813A

United States Patent [19]

Tadashi

[11] Patent Number: 5,482,813

[45] Date of Patent: Jan. 9, 1996

[54] RADIOLOGICAL IMAGE FORMING METHOD

[75] Inventor: Ito Tadashi, Kanagawa, Japan

[73] Assignee: Fuji Photo Film Co., Ltd., Kanagawa, Japan

[21] Appl. No.: 281,078

[22] Filed: Jul. 27, 1994

[30] Foreign Application Priority Data

Jul. 28, 1993 [JP] Japan ..... 5-185999

[51] Int. Cl.[6] ..... G03C 5/16

[52] U.S. Cl. ..... 430/139; 430/502; 430/967; 430/523; 250/483.1; 250/487.1

[58] Field of Search ..... 430/139, 502, 430/967, 523; 250/483.1, 487.1

[56] References Cited

U.S. PATENT DOCUMENTS 4,701,403 10/1987 Miller ..... 430/529
4,789,785 12/1988 Yamazaki et al. ..... 250/487.1
4,835,396 5/1989 Kitada et al. ..... 250/483.1
4,865,944 9/1989 Roberts et al. ..... 430/139
5,221,846 6/1993 Apple et al. ..... 250/483.1

*Primary Examiner*—Thomas R. Neville
*Attorney, Agent, or Firm*—Sughrue, Mion, Zinn, Macpeak & Seas

[57] ABSTRACT

A method for forming a radiological image using a silver halide photographic material comprising a transparent support having at least one silver halide emulsion layer on one side thereof and a backing layer on the opposite side to the silver halide emulsion layer, and a radiographic intensifying screen, wherein the radiographic intensifying screen has such characteristics that the absorbed dose is at least 25% of X-rays having an X-ray energy of 80 KVp, and the contrast transfer function (CTF) is at least 0.79 at a spatial frequency of 1 line/mm and at least 0.36 at a spatial frequency of 3 lines/mm.

3 Claims, No Drawings

RADIOLOGICAL IMAGE FORMING METHOD

FIELD OF THE INVENTION

The present invention relates to a novel radiological image forming method wherein a silver halide photographic material having a backing layer is exposed to light from one side thereof. More particularly, it relates to a radiological image forming method using a silver halide photographic material which provides an excellent image in the field of X-ray photograph.

BACKGROUND OF THE INVENTION

The images of the tissues of patients in medical radiographs are prepared by using a photographic material (a silver halide photographic material) comprising a transparent support having at least one light-sensitive silver halide emulsion layer coated thereon, and recording an X-ray transmitted pattern on the silver halide photographic material. The X-ray transmitted pattern can be recorded by using the silver halide photographic material alone. However, since it is not desirable that the human body is exposed to a large dose of a radiation, X-ray photographing is usually conducted by combining the silver halide photographic material with a radiographic intensifying screen. The radiographic intensifying screen comprises a support having a phosphor layer provided on the surface thereof. X-rays are absorbed by the phosphor layer and converted into visible light having high light sensitivity to the photographic material. Hence, the use of the radiographic intensifying screen greatly improves the sensitivity of X-ray photographing systems.

As a method for further improving the sensitivity in the X-ray photographing systems, there has been developed a method wherein a light-sensitive material having photographic emulsion layers on both sides thereof, that is, a silver halide photographic material comprising a support having silver halide photographic emulsion layers on the front side thereof as well as on the back side thereof (i.e., on the opposite side of the front side) is put between radiographic intensifying screens (sometimes hereinafter referred to simply as intensifying screen) and subjected to X-ray photographing. This method is usually applied to X-ray photographing at present. This method is developed because the sufficient absorbed dose of X-rays can not be achieved by the use of only a sheet of the intensifying screen. Namely, even when the amount of the phosphor used in a sheet of the intensifying screen is increased to increase the absorbed dose of X-rays, visible light into which X-rays are converted within the phosphor layer having an increased thickness is scattered and reflected within the phosphor layer and, as a result, visible light which is emitted from the intensifying screen and is incident on the photographic material contacted with the intensifying screen is greatly made out-of-focus. Further, visible light emitted from the depth of the phosphor layer can be come out of the depth with difficulty. Accordingly, even when the amount of the phosphor layer is unnecessarily increased, effective visible light emitted from the intensifying screen is not increased. The X-ray photographing method using two sheets of the intensifying screens having an appropriate thickness has an advantage in that the absorbed dose of X-rays can be increased on the whole, and visible light into which X-rays are effectively converted can be emitted from the intensifying screens.

Studies have been continuously made to find out X-ray photographing systems having excellent balance between the image quality and the sensitivity. For example, there has been developed a combination of a blue light emitting intensifying screen having calcium tungstate phosphor layer with a silver halide photographic material which was not spectrally sensitized (e.g., a combination of High Screen standard with RX; both being trade names of Fuji Photo Film Co., Ltd.). Further, a combination of a green light emitting intensifying screen having a terbium activated rare earth element oxysulfide phosphor layer with an ortho spectrally sensitized silver halide photographic material (e.g., a combination of GRENEX with RXO; both being trade names of Fuji Photo Film Co., Ltd.) has been used in recent years. Both the sensitivity and the image quality have been improved.

The silver halide photographic material having photographic emulsion layers on both sides thereof has a problem in that the image quality is liable to be deteriorated by cross over light. The cross over light refers to visible light which is emitted from each of the intensifying screens arranged on both sides of the photographic material, transmitted through the support (usually a thick support of 170 to 180 μm is usually used) of the photographic material to the opposite sensitive layer thereto and deteriorates the image quality (particularly sharpness).

Various methods have been developed to reduce the above-described cross over light. For example, U.S. Pat. Nos. 4,425,425 and 4,425,426 disclose that spectrally sensitized tabular grain emulsions having a high aspect ratio are used as light-sensitive silver halide photographic emulsions, whereby cross over light can be reduced to 15 to 22%. Further, U.S. Pat. No. 4,803,150 discloses that a microcrystalline dye layer which can be decolorized by development processing is provided between the support of the silver halide photographic material and the light-sensitive layer thereof, whereby cross over light can be reduced to 10% or below.

However, a large amount of the dye is required to make cross over light zero, and the dye is left behind after development processing. Namely, there are caused problems that a residual color is formed, and the layer strength of the photographic material is lowered by adding a large amount of the dye. It is difficult that the well-balanced properties between the image quality and the layer strength can be obtained.

On the other hand, the photographic material having a backing layer, that is, one side photographic material does substantially not suffer from cross over light, that is, cross over light is substantially zero. Accordingly, it is necessary that studies are made on the photographic material having a backing layer to improve the sensitivity and the image quality.

SUMMARY OF THE INVENTION

An object of the present invention is to provide a radiological image forming method which provides more advantageously an image in a combination of a silver halide photographic material having a backing layer with a radiographic intensifying screen.

The present inventors have eagerly made studies. As a result, the above-described object of the present invention has been achieved by providing a radiological image forming method using a silver halide photographic material comprising a transparent support having at least one silver halide emulsion layer on one side thereof and a backing layer on the opposite side to the silver halide emulsion layer, and a radiographic intensifying screen arranged on the back side of the photographic material, wherein the radiographic intensifying screen has such characteristics that the absorbed dose is at least 25% of X-rays having an X-ray energy of 80 KVp, and the contrast transfer function (CTF) is at least 0.79 at a spatial frequency of one line/mm and at least 0.36 at a spatial frequency of 3 lines/mm.

DETAILED DESCRIPTION OF THE INVENTION

Now, the present invention will be illustrated in detail below.

The term "backing layer" as used herein refers to a layer which is a colored antihalation layer coated on the opposite side of the support to the silver halide emulsion layer side thereof so that light transmitted through the light-sensitive layer is not reflected, and visible light is absorbed.

It is preferred that water-soluble polymers are used in the backing layer. The water-soluble polymers which can be preferably used in the present invention are those which are soluble in water, though solubility in water is not always high.

For example, at least 0.05 g (preferably at least 0.1 g) of the polymer may be dissolved in 100 g of water at 20° C. The water-soluble polymers having high solubility in developing solutions or fixing solutions are preferred. More specifically, the solubility of the polymers is such that preferably at least 0.05 g, more preferably at least 0.5 g, most preferably at least 1 g thereof is soluble in 100 g of the developing solutions.

The water-soluble polymers may be any of natural polymers and synthetic polymers.

The water-soluble polymers are used in an amount of preferably at least 3%, more preferably at least 5%, of the total weight of gelatin coated on the backing layer-coated side of the photographic material.

The layer to which the water-soluble polymers are added may be any layer of the backing layer-coated side. Examples of the layer include the backing layer, the surface protective layer (for the backing layer), the undercoat layer and the interlayer. However, the backing layer and/or the surface protective layer are/is preferred.

The water-soluble polymers may be added at any stage before the coating of the backing layer.

Dyes used for providing the colored layer must have proper spectral absorption characteristics meeting the color sensitivity of light-sensitive materials and must meet the following conditions.

(1) The dyes do not have any adverse effect on photographic characteristics and are chemically inert.

(2) The dyes are decolorized during the course of development processing or are dissolved out during processing or rinsing so that undesired coloration is not left behind in the light-sensitive materials after processing.

Another requisite is such that the surface side and the back side can be easily distinguished from each other when the films are handled under safelight in a darkroom.

The dyes meeting the above requirements have been studied for many years. Examples of the dyes conventionally used include water-soluble dyes such as oxonol dyes, hemioxonol dyes, cyanine dyes, merocyanine dyes, styryl dyes and azo dyes. Of these dyes, oxonol dyes and hemioxonol dyes are useful.

When at least two kinds of the water-soluble dyes are used, the amount of the dyes used is preferably 200 mg/m$^2$ or less, and more preferably 100 mg/m$^2$ or less, per one kind among the plural kinds of the dyes used.

The dyes which can be preferably used in the backing layer according to the present invention include those described in U.S. Pat. No. 2,274,782, British Patent 446,583, JP-B-39-22069 (the term "JP-B" as used herein means an "examined Japanese patent publication") and JP-A-57-185038 (the term "JP-A" as used herein means an "unexamined published Japanese patent application"). Particularly, the dyes described in JP-A-57-185038 are preferred.

Gelatin used in the backing layer of the present invention includes lime-processed gelatin, acid-processed gelatin and enzyme-processed gelatin. A part of gelatin may be replaced with a synthetic or natural high-molecular material. Gelatin is used in an amount of preferably 4.0 g/m$^2$ or less and more preferably 3.5 g/m$^2$ or less. When the amount of gelatin is too large, the drying characteristics of the photographic materials are deteriorated and the dissolving-out of the dyes is deteriorated. The backing layer may optionally contain inorganic fine particles such as colloidal silica and organic plasticizers such as an ethyl acrylate/acrylic acid copolymer as layer (quality) improvers.

It is preferred that an overcoat layer is provided on the backing layer of the present invention. When the overcoat layer is provided, the transfer and dye-bleeding of the dyes are improved. Further, it is preferred that the overcoat layer contains matting agents. The matting agents are organic or inorganic fine particles having a particle size of 0.1 to 10 μm and are well known in the art. The overcoat layer may be composed of two or more layers. It is preferred that the backing layer and the overcoat layer are simultaneously coated.

When at least two kinds of the matting agents are used, the amount of the matting agents used is preferably 200 mg/m$^2$ or less and more preferably 100 mg/m$^2$ or less, per one kind among the plural kinds of the matting agents used.

Examples of surfactants which can be used in the present invention include natural surfactants such as saponin; nonionic surfactants such as alkylene oxide type, glycerin type and glycidol type; cationic surfactants such as higher alkylamines, quaternary ammonium salts, phosphoniums and sulfoniums; anionic surfactants such as carboxylic acids, sulfonic acids, phosphoric acids and sulfuric acid esters; ampholytic surfactants such as amino acids, aminosulfonic acids and aminoalcohol esters; and fluorinated surfactants wherein a part of the above surfactant is replaced by a fluoroalkyl group.

The swelling ratio of the backing layer-coated side of the photographic material in the present invention is preferably 180% or below, more preferably 150% or below.

It is known that the hardening degree of the photographic material can be evaluated by the melting time. The melting time of the backing layer-coated side of the photographic material in the present invention is preferably 60 minutes or longer. It is particularly preferred that the layer is peeled off from the support before the layer is dissolved out.

The swelling ratio of the emulsion layer-coated side is preferably 180% or more, more preferably 200 to 300%. When the swelling ratio is too low, the development rate and the property with regard to the residual colors of the sensitizing dyes are deteriorated, and rapid processability is lost, while when the swelling ratio is too high, the water content of the photographic material is increased and drying is conducted with difficulty.

The dry thickness of the backing layer-coated side in the present invention is preferably 1.5 to 4 μm, more preferably 2 to 3.5 μm.

The dry thickness of the emulsion layer-coated side is preferably 2 to 5 μm, more preferably 2.5 to 4 μm.

Silver halide contained in silver halide emulsions used in the present invention may be any of silver chloride, silver chlorobromide, silver bromide, silver iodobromide and silver chloroiodobromide. However, it is preferred that the iodide content is not higher than 1 mol % per mol of silver. The AgI distribution may be any of internal high content type and external (surface layer) high content type.

A cadmium salt, a zinc salt, a lead salt, a thallium salt, an iridium salt or a complex salt thereof, a rhodium salt or a complex salt thereof, or an iron salt or a complex salt thereof may be allowed to coexist during the formation of silver halide grains or the physical ripening thereof. If desired, the silver halide grains may be chemically sensitized.

It is necessary that the majority of the silver halide grains to be contained in the silver halide emulsions comprise tabular grains. More specifically, the tabular grains occupy at least 50%, preferably at least 70% of the projected areas of the entire silver halide grains contained in the emulsion layer. The diameter of the tabular grain is defined as the diameter of a circle having an area equal to the projected area of the grain. The aspect ratio of the tabular grain refers to the ratio of the diameter of the tabular grain to the thickness thereof. The average aspect ratio refers to the mean value of the ratios of the diameters of the tabular grains to the thicknesses thereof. The average aspect ratio of the tabular grain used in the present invention is at least 3, but lower than 20, preferably at least 4, but lower than 10. The thickness of the tabular grain is preferably not more than 3 μm, particularly preferably not more than 0.2 μm.

The tabular silver halide emulsions can be easily prepared by referring to the methods described in JP-A-58-127927, JP-A-58-113927 and JP-A-58-113928. Further, the tabular silver halide emulsions can be obtained in the following manner. Seed crystals comprising at least 40% by weight of tabular grains are formed in a relatively low pBr atmosphere such as at a pBr of 1.3 or below, and the seed crystals are grown while a silver salt solution and a halide solution are simultaneously added thereto at a pBr similar to that described above. It is desirable that the silver salt solution and the halide solution are added with care so that a new crystal nucleus is not formed during the course of the growth of the grains. The size of the tabular silver halide grains can be controlled by temperature control, the choice of the types and amounts of solvents and the control of the addition rate of the silver salt solution and the halide solution used during the course of the growth of the grains.

It is preferred that the emulsion layer of the present invention contains at least $1.0\times10^{-3}$ mol, but less than $2.0\times10^{-2}$ mol of a thiocyanic acid compound per mol of silver. The thiocyanic acid compound may be added at any stage of grain formation, physical ripening, grain growth, chemical sensitization and coating. However, it is preferred that the compound is added before chemical sensitization.

Water-soluble salts of thiocyanic acid such as metal salts and ammonium salts of thiocyanic acid can be generally used as the thiocyanic acid compound used during the preparation of the silver halide emulsions used in the present invention. When metal salts are used, a metal element which does not have any adverse effect on photographic performance should be chosen. Potassium salt and sodium salt are preferred. Sparingly soluble salts such as AgSCN may be added in the form of fine particles. Fine particles of AgSCN have a diameter of preferably not larger than 0.2 μm, particularly preferably not larger than 0.05 μm.

The silver halide emulsions used in the present invention may be subjected to chemical sensitization. Examples of the chemical sensitization method which can be used in the present invention include conventional methods such as sulfur sensitization method, selenium sensitization method, reduction sensitization method using complex salts and polyamines, gold sensitization method using gold compounds and sensitization method using metals such as iridium, platinum, rhodium and palladium. These sensitization methods may be used in combination.

Particularly, it is preferred that sulfur sensitization method using a sulfur containing compound and/or selenium sensitization method using a selenium compound are/is carried out in the presence of a compound which is adsorbed by silver halide.

The term "compound which is adsorbed by silver halide" as used herein means spectral sensitizing dyes or photographic stabilizing agents. Compounds described in JP-A-63-305343 and JP-A-1-77047 can be used.

The silver halide photographic materials used in the present invention must be sensitive to the intensifying screen used together with the silver halide photographic materials. Usual silver halide emulsions are sensitive to light in the region of blue light to ultraviolet light. When light emitted from the intensifying screen is in the region of blue light to ultraviolet light, the silver halide emulsions can be used (e.g., an intensifying screen using a calcium tungstate phosphor can be applied to this case). However, when an intensifying screen using a terbium-activated gadolinium oxysulfide phosphor emitting light having a dominant wavelength of 545 nm is used, it is necessary that silver halide is spectrally sensitized to green. Sensitizing dyes may be added at any stage. However, it is preferred that the sensitizing dyes are added before chemical sensitization.

The coated silver amount of the light-sensitive material is preferably 0.5 to 5 g/m$^2$ (per one side), more preferably 1.4 to 3.2 g/m$^2$ (per one side). It is preferred from the standpoint of rapid processability that the coated silver amount does not exceed 5 g/m$^2$.

Various additives described in, for example, the following patent application in addition to the above-described compounds can be used for the photographic materials used in the present invention. Places where additives are described are listed below.

| Item | Places |
|---|---|
| 1. Silver Halide Emulsion and Preparation | the 6th line from the bottom of right lower column of page 8 to the 12th line of right upper column of page 10 of JP-A-2-68539; the 10th line of right lower column of page 2 to the first line of right upper column of page 6 of JP-A-3-24537; the 16th line of left upper column of page 10 to the 19th line of page 11 of JP-A-4-107442 (corresponding to U.S. Patent 5,206,134) |
| 2. Chemical Sensitization Method | the 13th line of right upper column to the 16th line of left upper column of page 10 of JP-A-2-68539; and |

-continued

| Item | Places |
|---|---|
| | Japanese Patent Application No. 3-105036 |
| 3. Antifogging Agent, Stabilizer | the 17th line of left lower column of page 10 to the 7th line of left upper column of page 11 of JP-A-2-68539; and the 2nd line of left lower column of page 3 to left lower column of page 4 of JP-A-2-68539 |
| 4. Color Tone Improver | the 7th line of left lower column of page 2 to the 20th line of left lower column of page 10 of JP-A-62-276539; and the 15th line of left lower column of page 6 to the 19th line of right upper column of page 11 of JP-A-3-94249 |
| 5. Spectral Sensitizing Dye | the 4th line of right lower column of page 4 to right lower column of page 8 of JP-A-2-68539 |
| 6. Surfactant, Antistatic Agent | the 14th line of left upper column of page 11 to the 9th line of left upper column of page 12 of JP-A-2-68539 |
| 7. Matting Agent, Lubricant, Plasticizer | the 10th line of left upper column to the 10th line of right upper column of page 12 of JP-A-2-68539; and the 10th line of left lower column to the first line of right lower column of page 14 of JP-A-2-68539 |
| 8. Hydrophilic Colloid | the 11th line of right upper column to the 16th line of left lower column of page 12 of JP-A-2-68539 |
| 9. Hardening Agent | the 17th line of right upper column of page 12 to the 6th line of right upper column of page 13 of JP-A-2-68539 |
| 10. Support | the 7th line to the 20th line of right upper column of JP-A-2-68539 |
| 11. Dye, Mordant | the first line of left lower column of page 13 to the 9th line of left lower column of page 14 of JP-A-2-68539; and left lower column of page 14 to right lower column of page 16 of JP-A-3-24539 |
| 13. Polyhydroxy-benzenes | left upper column of page 11 to left lower column of page 12 of JP-A-3-39948; and EP 452,772A |
| 14. Layer Construction | JP-A-3-198041 |
| 15. Processing | the 7th line of right upper column of page 16 to the 15th line of left lower column of page 19 of JP-A-2-103037; and the 5th line of right lower column of page 3 to the 10th line of right upper column of page 6 of JP-A-2-115837 |

It has been found that a good image quality and good sensitivity can be obtained when an image is formed by using the silver halide photographic material having the backing layer in combination with a relatively good intensifying screen which has high sensitivity and such characteristics that CTF (contrast transfer function) is at least 0.79 at a spatial frequency of one line/mm and at least 0.36 at a spatial frequency of 3 lines/mm.

The photographic material and the intensifying screen may be used in an arbitrary combination. However, when they are used in a specific combination, a balance between more improved image quality and sensitivity can be obtained. For example, when a high-sensitivity intensifying screen which absorbs X-rays in very large doses is combined with a low-sensitivity photographic material while the sensitivity of the combination is kept at a given value, the resulting image has very good graininess, but the sharpness of the image is extremely lowered. In this case, even when a photographic material having low sensitivity but high sharpness is used as the photographic material, an image having sufficient sharpness cannot be obtained, and a diagnostically preferred X-ray image cannot be obtained. On the other hand, when a low-sensitivity intensifying screen which absorbs a small dose of X-rays is used in combination with a photographic material having standard sensitivity or high sensitivity, the resulting image has poor graininess and a diagnostically preferred X-ray image cannot be obtained, though an X-ray image having high sharpness can be obtained. The best combination is that a relatively high-sensitivity intensifying screen having such characteristics that the absorbed dose of X-rays is at least 25% of X-rays having an X-ray energy of 80 KVp, and CTF is at least 0.79 (one line/mm) and at least 0.36 (3 lines/mm), is combined with a photographic material having sensitivity lower by a value than that of the intensifying screen, said value canceling the high-sensitivity characteristics of the intensifying screen.

The present inventors have made studies and found that the best proportion of the sensitivity of the intensifying screen and that of the photographic material in the combination of the silver halide photographic material with the radiographic intensifying screen varies depending on the sensitivity level of the combination, the size of the subject, etc. The present inventors have further studied and found that an X-ray image having sufficient sensitivity and high quality can be obtained when a photographic material having moderate sensitivity is used, and an intensifying screen is prepared so that the absorbed dose of X-rays is increased by increasing the amount of the phosphor to such an extent that an acceptable level of sharpness can be kept, and a high contrast transfer function (CTF) can be obtained.

The preferred level of sharpness varies depending on the size of the subject. For example, when the clinical evaluation in the chest is represented in terms of the physical amount of contrast transfer function (CTF), the contrast transfer function (CTF) over a range of from a spatial frequency of 0.5 line/mm to a spatial frequency of 3 lines/mm is important, and the value is such that CTF is preferably at least 0.65 at a spatial frequency of one line/mm and at least 0.22 at a spatial frequency of 2 lines/mm. Further, there is a limit in the sensitivity of the combination. This is because when a composition providing high sensitivity is chosen, an image of high quality for diagnostic use cannot be obtained even though a combination having the most preferred balance is prepared. On the other hand, a low-sensitivity combination is not preferred from the standpoint of the problem with regard to exposure to X-rays.

The radiographic intensifying screen of the present invention will be illustrated in detail below.

The radiographic intensifying screen comprises basically a support and a phosphor layer provided on one side of the support. The phosphor layer is a layer composed of a phosphor dispersed in a binder. Generally a transparent protective layer is provided on the surface of the phosphor layer (said surface being the side of the phosphor layer which does not face the support) to thereby protect the phosphor layer from chemical modification or physical shock.

Phosphors which can be preferably used in the radiographic intensifying screen of the present invention include compounds represented by the following formula.

$$M_{(w-n)}M'_nO_wX$$

wherein M represents at least one member selected from the group consisting of metallic yttrium, lanthanum, gadolinium and lutetium; M' represents at least one rare earth element, preferably dysprosium, erbium, europium, holmium, neodymium, praseodymium, samarium, cerium, terbium, thulium or ytterbium; X represents intermediate chalcogen (e.g., S, Se or Te) or a halogen atom; n is a number of 0.0002 to 0.2; and w is 1 when X is a halogen atom, or w is 2 when X is chalcogen.

Specific examples of the phosphors for radiographic intensification which can be preferably used in the radiographic intensifying screen of the present invention include the following phosphors.

Terbium-activated rare earth element oxysulfide phosphors (e.g., $Y_2O_2S$:Tb, $Gd_2O_2S$:Tb, $La_2O_2S$:Tb, (Y, Gd)$_2O_2S$:Tb, (Y, Gd)$_2O_2S$:Tb, Tm, etc.), terbium-activated rare earth element oxyhalide phosphors (e.g., LaOBr:Tb, LaOBr:Tb, Tm, LaOCl:Tb, LaOCl:Tb, Tm, GdOBr:Tb, GdOCl:Tb, etc.) and thulium-activated rare earth element oxyhalide phosphors (e.g., LaOBr:Tm, LaOCl:Tm, etc.). Of these phosphors which can be used in the radiographic intensifying screen of the present invention, terbium-activated gadolinium oxysulfide phosphors are particularly preferred. The terbium-activated gadolinium oxysulfide phosphors are described in U.S. Pat. No. 3,725,704 in detail.

The phosphor layer is generally coated on the support by conventional coating methods under atmospheric pressure described below. Namely, a particulate phosphor and a binder are mixed and dispersed in each other in an appropriate solvent to prepare a coating solution. The coating solution is directly coated on the support for the radiographic intensifying screen under atmospheric pressure by using a coating means such as doctor blade, a roll coater or a knife coater, and then the solvent is removed from the resulting coated film. Alternatively, the coating solution is previously coated on a temporary support such as glass sheet under atmospheric pressure, and the solvent is removed from the coated film to form a thin film of a phosphor containing resin. The thin film is transferred onto the support for the radiographic intensifying screen, thereby providing the phosphor layer on the support.

The radiographic intensifying screen used in the present invention can be prepared by conventional methods described above. However, it is preferred that the radiographic intensifying screen is prepared by using a thermoplastic elastomer as the binder and conducting a compression treatment to thereby increase the packing rate of the phosphor (namely, the void in the phosphor layer is reduced).

The sensitivity of the radiographic intensifying screen depends basically on the total emission rate of the phosphor contained in the panel. The total emission rate varies depending on not only the emission brightness of the phosphor itself but also the amount of the phosphor contained in the phosphor layer. The high content of the phosphor means that a large dose of a radiation such as X-rays is absorbed. Accordingly, more higher sensitivity can be obtained, and at the same time, the image quality (particularly graininess) is improved. On the other hand, when the content of the phosphor contained in the phosphor layer is constant, the thickness of the phosphor layer can be thinned with increase in the packing rate of the phosphor particles. Accordingly, the spreading of the emitted light caused by scattering can be reduced, and relatively high sharpness can be obtained.

It is preferred that the radiographic intensifying screen is prepared by steps comprising:

(a) a step of forming a phosphor sheet comprising a binder and a phosphor; and then (b) a step of placing the phosphor sheet on a support, and bonding the phosphor sheet to the support while compressing them at a temperature of not lower than the softening point or melting point of the binder.

The step (a) will be illustrated below.

The phosphor sheet which forms the phosphor layer of the radiographic intensifying screen can be prepared in the following manner. A phosphor is uniformly dispersed in a binder solution to prepare a coating solution. The coating solution is coated on a temporary support for forming the phosphor sheet, and then dried. The resulting phosphor sheet is peeled off from the temporary support.

Namely, a binder and phosphor particles are added to an appropriate organic solvent. The mixture is mixed with stirring to prepare a coating solution composed of a phosphor uniformly dispersed in the binder solution.

A thermoplastic elastomer alone having a softening point or a melting point of 30 to 150° C. optionally together with other binder polymer is used as the binder. The thermoplastic elastomer has an elastic force at ordinary temperature and is made fluidized when heated. Accordingly, the phosphor can be prevented from being broken by pressure when compressed. Examples of the thermoplastic elastomer include polystyrene, polyolefins, polyurethane, polyesters, polyamides, polybutadiene, ethylene-vinyl acetate copolymers, polyvinyl chloride, natural rubber, fluororubber, polyisoprene, chlorinated polyethylene, styrene-butadiene rubber and silicone rubber.

The proportion of the thermoplastic elastomer in the binder may be at least 10% by weight, but not more than 100% by weight. However, it is preferred that the binder comprises a high proportion of the thermoplastic elastomer. It is particularly preferred that the binder comprises 100% by weight of the thermoplastic elastomer.

Examples of the solvent for use in the preparation of the coating solution include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters derived from lower fatty acids and lower alcohols such as methyl acetate, ethyl acetate and butyl acetate; ethers such as dioxane, ethylene glycol monoethyl ether and ethylene glycol monomethyl ether; and mixtures thereof.

The mixing ratio of the binder and the phosphor in the coating solution varies depending on the characteristics of the radiographic intensifying screen to be obtained and the types of the phosphors. However, the mixing ratio of the binder to the phosphor is generally in the range of from 1:1 to 1:100 by weight, preferably from 1:8 to 1:40 by weight.

The coating solution may contain various additives such as dispersants for improving the dispersibility of the phosphor in the coating solution and plasticizers for improving bonding power between the binder and the phosphor in the phosphor layer after formation of the phosphor layer. Examples of the dispersant include phthalic acid, stearic acid, caproic acid and lipophilic surfactants. Examples of the plasticizer include phosphoric esters such as triphenyl phosphate, tricresyl phosphate and diphenyl phosphate; phthalic esters such as diethyl phthalate and dimethoxyethyl phthalate; glycolic acid esters such as ethyl phthalylethyl glycolate and butyl phthalylbutyl glycolate; and polyesters derived from polyethylene glycol and aliphatic dibasic acids such as a polyester derived from triethylene glycol and adipic acid and a polyester derived from diethylene glycol and succinic acid.

The thus prepared coating solution containing the phosphor and the binder is uniformly coated on the surface of the temporary support for forming the sheet to form the film of the coating solution. The coating can be conducted by conventional coating means such as a doctor blade, a roll coater or a knife coater.

The temporary support may be any of glass sheet, metallic sheets and conventional materials which can be used as the support for the radiographic intensifying screen. Specific examples of the materials which can be used as the temporary support include films of plastics such as cellulose acetate, polyesters, polyethylene terephthalate, polyamides, polyimides, cellulose triacetates and polycarbonates; metallic sheets such as aluminum foil and aluminum alloy foil; plain paper, baryta paper, resin coated paper, pigmented paper containing a pigment such as titanium dioxide, sized paper (e.g., paper sized with polyvinyl alcohol) and ceramics plates or sheets such as plates or sheets of alumina, zirconia, magnesia and titania ceramics.

The coating solution for forming the phosphor layer is coated on the temporary support and then dried. The resulting film is released from the temporary support to obtain the phosphor sheet which can be used as the phosphor layer of the radiographic intensifying screen. Accordingly, it is preferred that a release agent is previously coated on the surface of the temporary support to thereby facilitate the removal of the phosphor sheet formed from the temporary support.

The step (b) will be illustrated below.

A support for the phosphor sheet obtained above is prepared. The materials used for the temporary support for forming the phosphor sheet in the step (a) above can be used as the support for the intensifying screen.

It is conventionally known in the field of the radiographic intensifying screen that a high-molecular material such as gelatin is coated on the surface of the support on which the phosphor layer is provided to form an adhesion imparting layer to strengthen the bonding of the support to the phosphor layer, or a light reflection layer comprising a light reflecting material such as titanium dioxide or a light absorbing layer comprising a light absorbing material such as carbon black is provided to improve the sensitivity or image quality (sharpness, graininess) of the radiographic intensifying screen. These layers may be provided on the support used in the present invention. The arrangement of these layer may be arbitrarily chosen according to the purpose and use of the radiographic intensifying screen.

The phosphor sheet obtained in the step (a) is put on the support, and the phosphor sheet is adhered to the support while the laminate is compressed at a temperature of not lower than the softening temperature or melting point of the binder.

As described above, the phosphor sheet can be thinly spread by compression without previously fixing the phosphor sheet to the support. Accordingly, the phosphor can be prevented from being damaged. In addition, the high packing rate of the phosphor can be achieved under the same pressure as that in the case where the phosphor sheet is fixed to the support and pressurized. Examples of compression devices which can be used for the compression treatment of the present invention include conventional devices such as calender rolls and hot press. For example, the compression treatment by using calender rolls is carried out by placing the phosphor sheet obtained in the step (a) on the support and passing them at a given speed through the rolls heated to a temperature of not lower than the softening temperature or melting point of the binder. The compression devices which can be used in the present invention are not limited to the above-described devices. Any of devices capable of compressing the sheet under heating can be used in the present invention.

The compression pressure is preferably at least 50 kgw/$cm^2$.

A transparent protective film is provided on the surface of the phosphor layer opposite to the support (namely, the surface of the phosphor layer is the side which does not face the support) in conventional radiographic intensifying screen to thereby protect the phosphor layer physically and chemically. It is preferred in the present invention that the radiographic intensifying screen of the present invention is provided with the transparent protective film.

The thickness of the protective film is generally in the range of about 0.1 to 20 μm.

The transparent protective film can be formed by dissolving a transparent high-molecular material such as a cellulose derivative (e.g., cellulose acetate or cellulose nitrate) or a synthetic high-molecular material (e.g., polymethyl methacrylate, polyvinyl butyral, polyvinyl formal, a polycarbonate, polyvinyl acetate or a vinyl chloride-vinyl acetate copolymer) in an appropriate solvent and coating the resulting solution on the surface of the phosphor layer. Alternatively, a sheet for forming the protective film such as a plastic sheet (e.g., a sheet of polyethylene terephthalate, polyethylene naphthalate, polyethylene, polyvinylidene chloride or a polyamide) or a transparent glass sheet can be separately prepared and adhered to the surface of the phosphor layer by using an adhesive to form the protective film on the surface of the phosphor layer.

It is preferred that the protective film for the radiographic intensifying screen of the present invention is a film formed by using a coating solution containing a fluororesin soluble in organic solvents. The term "fluororesin" as used herein refers to a homopolymer or a copolymer of a fluorine containing olefin (fluoroolefin). The coated film formed by using the coating solution containing the fluororesin may be crosslinked. The protective film comprising the fluororesin has an advantage in that stains formed by the plasticizer, etc., soak into the inner portion of the protective film with difficulty, and hence stains can be easily removed by wiping stains off, said plasticizer, etc., which are oozed out from the X-ray films or other materials when the protective film is brought into contact with X-ray films or other materials.

When the fluororesin soluble in organic solvents is used as the protective film forming material, the protective film can be easily formed by dissolving the resin in an appropriate solvent, coating the resulting solution and drying the coated film. Namely, the protective film can be formed by dissolving the fluororesin in an organic solvent, coating uniformly the resulting coating solution on the surface of the phosphor layer using a coating means such as a doctor blade and then drying the coated film. The protective film may be formed simultaneously by coating the protective film and the phosphor layer.

The fluororesin is a homopolymer of a fluorine containing olefin (fluoroolefin) or a copolymer thereof. Examples of the fluororesin include polytetrafluoroethylene, polychlorotrifluoroethylene, polyvinyl fluoride, polyvinylidene fluoride, a tetrafluoroethylene-hexafluoropropylene copolymer and a fluoroolefin-vinyl ether copolymer. Fluororesins are generally insoluble in organic solvents. However, the copolymers of fluoroolefins can be made soluble in organic solvents by using appropriate comonomers (excluding fluoroolefins). Accordingly, the protective film can be easily formed by dissolving the fluororesin in an appropriate solvent, coating the resulting solution on the surface of the phosphor layer and then drying the coated film. Examples of the copolymers which can be used for the formation of the protective film include fluoroolefin-vinyl ether copolymers. Further, since polytetrafluoroethylene and modified products thereof are soluble in appropriate solvents such as perfluoro solvents, the protective film can be formed by coating in the same manner as the coating solution containing the above copolymers of the fluoroolefins.

The protective film may contain other resins such as crosslinking agents, hardening agents and anti-yellowing agents in addition to the fluororesin. However, it is preferred from the viewpoint of achieving the above-described purpose that a fluororesin content of the protective film is preferably at least 30% by weight, more preferably at least 50% by weight, most preferably at least 70% by weight. Examples of the resins which can be contained in the protective film in addition to the fluororesin include polyurethane resins, polyacrylic resins, cellulose derivatives, polymethyl methacrylate, polyester resins and epoxy resins.

The protective film of the intensifying screen of the present invention may be formed from a coated film containing either one or both of a polysiloxane skeleton-containing oligomer and a perfluoroalkyl group-containing oligomer. For example, the polysiloxane skeleton-containing oligomer has a dimethylsiloxane skeleton, preferably at least one functional group (e.g., hydroxy group) and a molecular weight (weight average) of preferably 500 to 100,000, more preferably 1,000 to 100,000, most preferably 3,000 to 10,000. The perfluoroalkyl group (e.g., tetrafluoroethylene group)-containing oligomer has preferably at least one functional group (e.g., hydroxy group; —OH) and a molecular weight (weight average) of preferably 500 to 100,000, more preferably 1,000 to 100,000, most preferably 10,000 to 100,000. When an oligomer having a functional group is used, a crosslinking reaction between the oligomer and the protective film forming resin takes place during formation of the protective film, and the oligomer is introduced into the molecular structure of the protective film forming resin. As a result, even when the radiographic intensifying screen is repeatedly used over a long period of time or even when the surface of the protective film is subjected to cleaning, the oligomer is not removed from the protective film, and the effect of the oligomer added persists over a long period of time. Accordingly, it is advantageous that the oligomer having at least one functional group is used.

The amount of the oligomer contained in the protective film is preferably 0.01 to 10% by weight, particularly preferably 0.1 to 2% by weight.

The protective film may contain perfluoroolefin resin powder or silicone resin powder. The perfluoroolefin resin powder or the silicone resin powder has an average particle size of preferably 0.1 to 10 μm, particularly preferably 0.3 to 5 μm. The amount of the perfluoroolefin resin powder or the silicone resin powder contained in the protective film is preferably 0.5 to 30% by weight, more preferably 2 to 20% by weight, still more preferably 5 to 15% by weight based on the weight of the protective film.

The radiographic intensifying screen used in the present invention has high sensitivity and is prepared so as to provide such characteristics that the contrast transfer function (CTF) is at least 0.79 at a spatial frequency of one line/mm (1 p/mm) and at least 0.36 at a spatial frequency of 3 lines/mm (1 p/mm) as described above.

It is particularly preferred that the radiographic intensifying screen used in the present invention has the following characteristics. A graph wherein the abscissa axis represents the spatial frequency (lines/mm), and the ordinate axis represents the value of the contrast transfer function (CTF) is prepared. The points represented by the following spatial frequencies (lines/mm) and the following CTF values are joined to each other in order so as to form a smooth curve. When the spatial frequency (lines/mm) and the CTF value on the resulting curve are compared with each other, it is particularly preferred that the radiographic intensifying screen has CTF values which are higher than those on the curve over the whole region of the spatial frequency.

| Lines/mm | CTF |
|---|---|
| 0.00 | 1.00 |
| 0.25 | 0.950 |
| 0.50 | 0.905 |
| 0.75 | 0.840 |
| 1.00 | 0.790 |
| 1.25 | 0.720 |
| 1.50 | 0.655 |
| 1.75 | 0.595 |
| 2.00 | 0.535 |
| 1.50 | 0.430 |
| 3.00 | 0.360 |
| 3.50 | 0.300 |
| 4.00 | 0.255 |
| 5.00 | 0.180 |
| 6.00 | 0.130 |

The measurement and calculation of the contrast transfer function from the radiographic intensifying screen to the photographic material can be made by using a sample obtained by printing a rectangular chart on MRE single-sided material (a product of Eastman Kodak Co.).

The radiographic intensifying screen having the above-described preferred characteristics can be obtained, for example, by the above-described method wherein the thermoplastic elastomer is used as the binder, and the phosphor layer is subjected to the compression treatment.

It is preferred that the protective layer of the radiographic intensifying screen is a transparent synthetic resin layer having a thickness of not larger than 5 μm coated on the phosphor layer. When such a thin protective layer is used, a distance between the phosphor of the radiographic intensifying screen and the silver halide photographic material is short so that such a thin protective layer contributes to an improvement in the sharpness of the resulting X-ray image.

In order to provide the combination of the silver halide photographic material with the radiographic intensifying screen which has the sensitivity which does not cause practically any problem and moreover which provides an X-ray image having a high-level image quality when photographed, it is preferred that the combination has such sensitivity that the silver halide photographic material having the backing layer to be combined with the radiographic intensifying screen provides a density of 1.0 when exposure of 0.5 to 1.5 mR is conducted by using a three-phase X-ray source of 80 KVp, and processing is conducted with the above-described developing solutions under the above-described processing conditions.

The measuring method used for the evaluation of the combination of the silver halide photographic material having the backing layer with the radiographic intensifying screen and the grounds thereon will be illustrated below.

A method for measuring the image efficiency of the combination of the silver halide photographic material for X-ray photographing with the radiographic intensifying screen which is generally used includes the measurement of detected quantum efficiency (DQE). A method for measuring the image for evaluating the sharpness and the graininess on the whole includes the measurement of noise equivalent quantum (NEQ). DQE is a value obtained by dividing the $(\text{signal/noise})^2$ value of the image by the $(\text{signal/noise})^2$ value of input X-rays, said image being finally formed on the photographic material by X-ray photographing using the combination. When an ideal image formation is made, the value is [1]. However, the value is usually less than 1. NEQ is the numerical value represented by the $(\text{signal/noise})^2$ value of the final image. There is the following relation between DQE and NEQ.

$$DQE(\nu)=NEQ(\nu)/Q$$

$$NEQ(\nu)=\{\log e\times\gamma\,(MTF(\nu)\}^2/NPS_0(\nu)$$

wherein $\gamma$ is contrast; MTF ($\nu$) is modulation transfer function of image; $NPS_0$ ($\nu$) is output noise power spectrum; $\nu$ is spatial frequency; and Q is incident X-ray quantum number.

The relation between the sensitivity and the image quality can be evaluated by DQE. The combination having high DQE means that the balance between the sensitivity and the image quality is superior. The image quality of the final image can be evaluated by NEQ. Namely, it can be judged that the higher NEQ, the image quality is better. However, NEQ is a value which means the physical evaluation of the image, and it is not always considered that NEQ corresponds to the clinical identifiability of the image with one-to-one accuracy. This is because when there is an extremely great difference between the graininess of the image and the sharpness thereof, it is not considered that the image has high visual reliability. Accordingly, it is desirable that evaluation is made by both NEQ and MTF to evaluate the image quality from the clinical standpoint.

The present invention is now illustrated in greater detail by reference to the following examples which, however, are not to be construed as limiting the invention in any way.

EXAMPLE 1

1. Preparation of Emulsion

An aqueous solution of 4.0 g of silver nitrate and an aqueous solution containing 5.9 g of potassium bromide were added to an aqueous solution containing 6.2 g of gelatin (having an average molecular weight of 15,000) and 6.9 g of potassium bromide in one liter of water kept at 40° C. with stirring over a period of 37 seconds by the double jet process. Subsequently, an aqueous solution containing 18.6 g of gelatin was added thereto, and the temperature of the mixture was raised to 60° C. while an aqueous solution containing 9.8 g of silver nitrate was added thereto over a period of 22 minutes. Further, 5.9 ml of a 25% aqueous solution of ammonia was added thereto. After 10 minutes, an aqueous solution containing 5.5 g of acetic acid was added thereto. Subsequently, an aqueous solution of 151 g of silver nitrate and an aqueous solution of potassium bromide were added thereto over a period of 35 minutes by the controlled double jet process while the potential was kept at a pAg of 8.8. The addition was made at such an accelerating flow rate that the flow rate at the time of the completion of the addition was 14 times that at the time of the commencement of the addition. After completion of the addition, 15 ml of a solution of 2N potassium thiocyanate was added thereto. The temperature of the mixture was then lowered to 35° C., and soluble salts were removed by the precipitation method. The temperature of the mixture was raised to 40° C., and 35 g of gelatin, 85 mg of Proxel and a thickener were added. The pH of the resulting emulsion was adjusted to 6.1 by using sodium hydroxide, and the pAg thereof was adjusted to 7.8 by using an aqueous solution of potassium bromide and an aqueous solution of silver nitrate. After the temperature of the emulsion was raised to 56° C., 3 mg of sodium ethylthiosulfonate was added thereto, and 0.1 mol % (based on the total amount of silver) of fine AgI particles having a diameter of 0.07 μm was added. Subsequently, 0.04 mg of thiourea dioxide was added. Further, 198 mg of 4-hydroxy-6-methyl-1, 3,3a,7-tetraazaindene and 426 mg of the following Dye-I were added. After 10 minutes, $0.52\times10^{-5}$ mol of the following Selenium Compound-I per mol of Ag, $1.03\times10^{-5}$ mol of sodium thiosulfate per mol of Ag, 30 mg of potassium thiocyanate and 6 mg of chloroauric acid were added, and the emulsion was ripened for 50 minutes. The emulsion was rapidly cooled to solidify it, thus obtaining Emulsion A. The resulting emulsion comprised grains having such a grain size distribution that grains having an aspect ratio of not lower than 3 accounted for 93% of the sum total projected areas of the entire grains, and grains having an aspect ratio of not lower than 4 accounted for 65% of the entire projected areas of the entire grains. With regard to all grains having an aspect ratio of not lower than 3, the grains had a grain size (in terms of the average diameters of the projected areas) of 0.83 μm, a coefficient of variation of 15%, an average thickness of 0.14 μm and an average aspect ratio of 6.2.

Dye-I

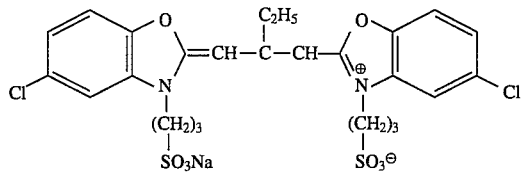

Selenium Compound-I

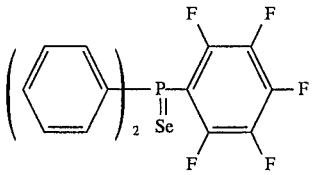

2. Preparation of Coating Solution for Emulsion Layer Side

Coating Solution for Emulsion Layer

The following reagents were added to the chemical sensitized Emulsion A to prepare Coating Solution a-1, each amount being per mol of silver halide.

| | |
|---|---|
| 2,6-Bis(hydroxyamino)-4-diethylamino-1,3,5-triazine | 72.0 mg |
| Dextran (having an average molecular weight of 39,000) | 3.9 g |
| Polypotassium Styrenesulfonate (having an average molecular weight of 600,000) | 0.7 g |
| Additive-I | 7.0 mg |
| Sodium Hydroquinonemonosulfonate | 8.2 g |
| Snowtex C (manufactured by Nissan Chemical Industries, Ltd.) | 10.5 g |
| Copolymer Latex of Ethyl Acrylate/Methacrylic Acid (97/3 by weight) | 9.7 g |

Gelatin (adjusted so that the amount of the emulsion layer coated was 2.6 $g/m^2$)

-continued

Hardening Agent (1,2-bis(vinylsulfonylacetamido)ethane) (adjusted so as to provide a swelling ratio of 230%)

Additive-I

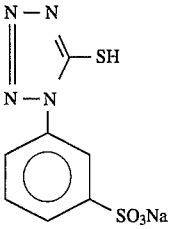

Preparation of Coating Solution for Surface Protective Layer

The following ingredients were used in such an amount as to provide the following coating amounts, thus preparing Coating Solution b-1.

| | |
|---|---|
| Gelatin | 650 mg/m$^2$ |
| Polysodium Acrylate (having an average molecular weight of 400,000) | 18 mg/m$^2$ |
| Copolymer of Butyl Acrylate/Methacrylic Acid (6/4 by weight) (having an average molecular weight of 120,000) | 120 mg/m$^2$ |
| Coating Aid-I | 18 mg/m$^2$ |
| Coating Aid-II | 45 mg/m$^2$ |
| Coating Aid-III | 0.9 mg/m$^2$ |
| Coating Aid-IV | 0.61 mg/m$^2$ |
| Coating Aid-V | 26 mg/m$^2$ |
| Additive-II | 1.3 mg/m$^2$ |
| Polymethyl Methacrylate (having an average particle size of 2.5 μm) | 87 mg/m$^2$ |
| Proxel | 0.5 mg/m$^2$ |
| Polypotassium Styrenesulfonate (having an average molecular weight of 600,000) | 0.9 mg/m$^2$ |

(The pH was adjusted to 7.4 by using NaOH)

Coating Aid-I

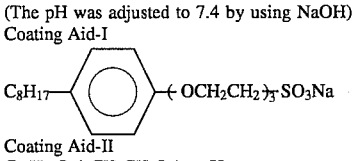

Coating Aid-II

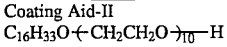

Coating Aid-III

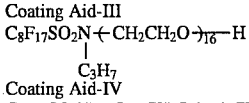

Coating Aid-IV

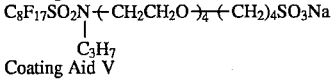

Coating Aid V

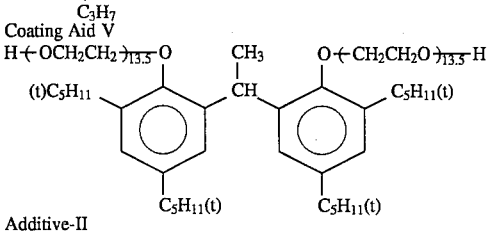

Additive-II

-continued

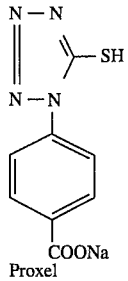

Proxel

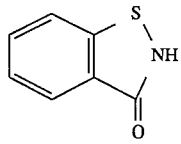

3. Preparation of Coating Solution for Backing Layer Side

Backing Layer (1) Preparation of Dye Dispersion L

A solution of 2.5 g of the following Dye-I, 2.5 g of the following Oil-I and 2.5 g of the following Oil-II dissolved in 50 ml of ethyl acetate was mixed with an 8% aqueous gelatin solution containing 1.5 g of sodium dodecylbenzenesulfonate and 0.18 g of methyl p-hydroxybenzoate at 60° C. The mixture was stirred in a homogenizer at a high speed. After completion of high-speed stirring, the mixture was treated in an evaporator at 60° C. under reduced pressure to remove 92% by weight of ethyl acetate, thereby obtaining the dye dispersion L having an average particle size of 0.18 μm.

(2) Preparation of Coating Solution

The following ingredients were used in such an amount as to provide the following coating amounts, thus preparing Coating Solution c-1.

| | |
|---|---|
| Phosphoric Acid | 5.2 mg/m$^2$ |
| Snowtex C (manufactured by Nissan Chemical Industries, Ltd.) | 0.5 mg/m$^2$ |
| Copolymer Latex of Ethyl Acrylate/Methacrylic Acid (97/3 by weight) | 0.5 mg/m$^2$ |
| Proxel | 4.2 mg/m$^2$ |
| Dye Dispersion L | 8.0 mg/m$^2$ |
| Dye-II | 75 mg/m$^2$ |
| Dye-III | 27 mg/m$^2$ |
| Dye-IV | 23 mg/m$^2$ |

Gelatin was added in such an amount so that the total amount of gelatin coated on the backing layer side was 3.0 g. Dextran having a molecular weight of 39,000 was added in such an amount as to provide a coating amount of 0.2 g/m$^2$.

Hardening agent (1,2-bis(vinylsulfonylacetamido)-ethane) was used in such an amount as to provide a swelling ratio of 160%.

Dye-I

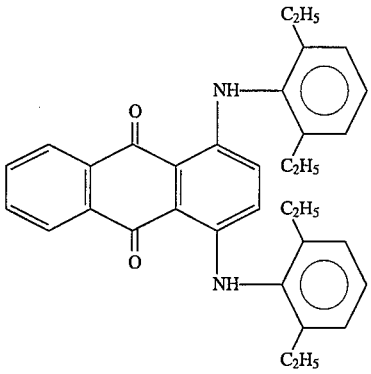

Dye-II

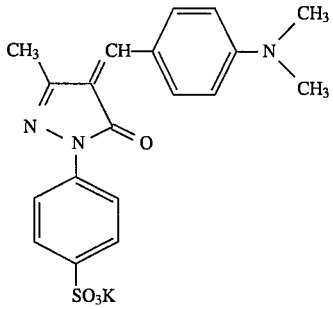

Dye-III

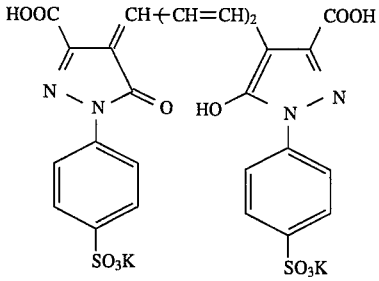

Dye-IV

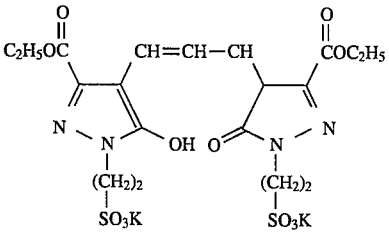

Oil-I

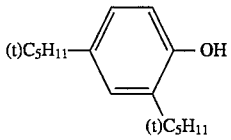

-continued

Oil-II

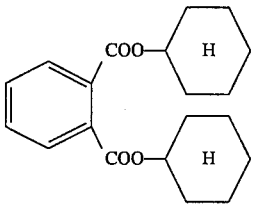

Surface Protective Layer

The following ingredients were used in such an amount as to provide the following coating amounts to prepare Coating Solution d-1.

| | |
|---|---|
| Gelatin | 1,000 mg/m$^2$ |
| Polymethyl Methacrylate | |
| average particle size: 4.80 μm | 32 mg/m$^2$ |
| average particle size: 0.75 μm | 81 mg/m$^2$ |
| Coating Aid-I | 20 mg/m$^2$ |
| Coating Aid-II | 40 mg/m$^2$ |
| Coating Aid-III | 6 mg/m$^2$ |
| Coating Aid-IV | 9 mg/m$^2$ |
| Coating Aid-VI | 1.7 mg/m$^2$ |
| Coating Aid-VII | 13 mg/m$^2$ |
| Proxel | 1.3 mg/m$^2$ |
| Polypotassium Styrenesulfonate (having an average molecular weight of 600,000) | 2 mg/m$^2$ |
| NaOH | 2.5 mg/m$^2$ |

Coating Aid-VI $C_8F_{17}SO_3K$

Coating Aid-VII

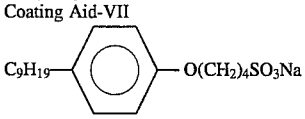

4. Preparation of Support

A biaxially oriented polyethylene terephthalate film of 183 μm in thickness was subjected to a corona discharge treatment and then coated with the following first undercoating solution having the following composition in such an amount so as to provide a coating amount of 5.1 ml/m$^2$. The coating was conducted by using a wire bar coater. The coated support was dried at 175° C. for one minute.

Subsequently, the first undercoat layer was provided on the side opposite to the above coated side in the same manner as described above. Polyethylene terephthalate used contained 0.04% by weight of Dye-I.

| | |
|---|---|
| Butadiene-Styrene Copolymer Latex Solution (solid content: 40%; butadiene/styrene = 31/35 by weight) | 79 ml |
| Sodium salt of 2,4-Dichloro-6-hydroxy-s-triazine (a 4% aqueous solution) | 20.5 ml |
| Distilled Water | 900.5 ml |

The latex solution contained 0.4% by weight of the following emulsifying dispersant based on the amount of the solid of the latex solution.

Emulsifying Dispersant

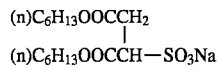

5. Preparation of Photographic Material

The antihalation layer and the surface protective layer were coated on the backing layer side of the support prepared above. Subsequently, the emulsion layer and the surface protective layer were simultaneously coated on other side of the support by an extrusion method to obtain Photographic Material 1. The coating amount of silver on the emulsion layer side was 2.8 g/m$^2$.

6. Preparation of Intensifying Screen

A coating solution for forming the phosphor sheet was prepared in the following manner. To methyl ethyl ketone solution were added 200 g of the phosphor ($Gd_2O_2S$:Tb), 20 g of Binder A (polyurethane; trade name: Desmolac TPKL-5-2625, manufactured by Sumitomo Bayer Urethane K.K.; solid content: 40%) and 2 g of Binder B (nitrocellulose; a degree of nitration: 11.5%). The mixture was dispersed in a propeller mixer to prepare a coating solution having a viscosity of 30 PS (25° C.) (the ratio of the binder/the phosphor=1/20). The resulting coating solution was coated on polyethylene terephthalate (temporary support of 180 μm in thickness) previously coated with a silicone release agent in such an amount as to provide a thickness of 160 μm (the thickness after the compression treatment under pressure described hereinafter). The coated film was dried and released from the temporary support to obtain the phosphor sheet.

Separately, a coating solution for forming an undercoat layer was prepared in the following manner. To methyl ethyl ketone were added 90 g of a soft acrylic resin and 50 g of nitrocellulose. The mixture was mixed and dispersed to prepare a dispersion having a viscosity of 3 to 6 PS (25° C.) as the coating solution for forming an undercoat layer.

Polyethylene terephthalate having titanium dioxide incorporated therein (support; thickness: 250 μm) was horizontally placed on a glass sheet. The above coating solution for forming an undercoat layer was uniformly coated on the support by using a doctor blade, and the coated film was dried while the temperature was gradually raised from 25° C. to 100° C. to thereby form an undercoat layer on the support (the thickness of the coated film: 15 μm). The phosphor sheet prepared above was put on the undercoated support, and the laminate was compressed at a temperature of 80° C. under a pressure of 400 kgw/cm$^2$ by using calender rolls.

Separately, 70 g of a fluororesin (a fluoroolefin/ vinyl ether copolymer; trade name: Lumiflon, manufactured by Asahi Glass Co., Ltd.), 25 g of a crosslinking agent (isocyanate, Desmodur Z 4370, manufactured by Sumitomo Bayer Urethane K.K.), 5 g of a bisphenol A type epoxy resin and 5 g of an alcohol-modified silicone oligomer (having a dimethylpolysiloxane skeleton; both terminals having hydroxy group (carbinol group); trade name: X-22-2809, manufactured by Shin-Etsu Kagaku Kogyo K.K.) were dissolved in a mixed solvent of toluene and isopropyl alcohol (1:1 by volume) to prepare a coating solution for forming the protective film.

The coating solution for forming the protective film was coated on the surface of the phosphor sheet on the support (which was compressed in the manner as described above) by using a doctor blade and heat-treated at 120° C. for 30 minutes to thereby conduct drying as well as thermosetting, thus forming a transparent protective film of 3 μm in thickness.

In this way, a radiographic intensifying screen comprising the support, the undercoat layer, the phosphor layer and the transparent protective film was prepared. The obtained radiographic intensifying screen was designated as Intensifying Screen A.

7. Measurement of Characteristics of Radiographic Intensifying Screen (1) Measurement of Absorbed Dose of X-Rays X-rays emitted from a tungsten target tube operated by a three-phase power source of 80 KVp was allowed to be transmitted through an aluminum sheet of 3 mm in thickness and to be reached the radiographic intensifying screen sample fixed at a position which was 200 cm away from the tungsten anode of the target tube. The dose of X-rays transmitted through the intensifying screen was measured by using an ionization type dosimeter which was 50 cm away from the phosphor layer of the intensifying screen to determine the absorbed dose of X-rays. The dose of X-rays which was not transmitted through the intensifying screen and measured at the same position as that described above was referred to as standard.

The measured values of the dose of X-rays absorbed by the intensifying screen are shown in Table 1 below.

(2) Measurement of Contrast Transfer Function (CTF)

MRE single-sided photographic material (manufactured by Eastman Kodak Co.) was arranged so that the photographic material was brought into contact with the intensifying screen to be measured, and a rectangular chart (made of molybdenum; thickness: 80 μm; spatial frequency: 0 line/mm to 10 lines/mm) for measuring MTF was photographed. The chart was placed at a position which was 2 m away from the X-ray tube. The photographic material was arranged in front of the X-ray source, and the intensifying screen arranged on the back side thereof.

The X-ray tube used was DRX-3724 HD (manufactured by Toshiba Corporation) using a tungsten target. The focal spot size was 0.6 mm×0.6 mm. X-rays were generated through 3 mm thick aluminum equivalent material including a diaphragm. A voltage of 80 KVp was applied to the three-phase power source by using a pulse generator, and X-rays transmitted through a filter of water of 7 cm having absorption nearly equivalent to the human body was used as the light source.

After photographing, the photographic material was processed in the following manner in a roller conveying type automatic processor (FPM-5000, manufactured by Fuji Photo Film Co., Ltd.) by conducting the development at 35° C. with the following Developing Solution I and then the fixing at 25° C. with Fixing Solution F (prepared by adding water to 200 ml of ammonium thiosulfate (70% w/v), 20 g of sodium sulfite, 8 g of boric acid, 0.1 g of disodium ethylenediaminetetraacetate dihydrate, 15 g of aluminum sulfate, 2 g of sulfuric acid and 22 g of glacial acetic acid to make the total volume one liter, and adjusting the pH to 4.5) to prepare a measuring sample. 'Automatic Processor FPM-5000 (manufactured by Fuji Photo Film Co., Ltd.)

Developing Solution I (described below)
Development Time: 25 sec; Temperature: 35° C.

Fixing Solution (described above)
Fixing Time: 20 sec; Temperature: 25° C.

Rinsing
Rinsing Time: 12 sec; Temperature: 25° C.

Drying
Drying Time: 26 sec; Temperature: 55° C. (Total Processing Time: 90 sec)

| Developing Solution I | |
|---|---|
| Potassium Hydroxide | 21 g |
| Potassium Sulfite | 63 g |
| Boric Acid | 10 g |
| Hydroquinone | 25 g |
| Triethylene Glycol | 20 g |
| 5-Nitroindazole | 0.2 g |
| Glacial Acetic Acid | 10 g |
| 1-Phenyl-3-pyrazolidone | 1.2 g |
| 5-Methylbenzotriazole | 0.05 g |
| Glutaric Aldehyde | 5 g |
| Potassium Bromide | 4 g |
| Water to make | 1 liter |
| The pH was adjusted to 10.02. | |

Exposure time was controlled so that the density of the portion with the high density of the photographed sample was 1.8. The results obtained are shown in Table 1.

(3) Measurement of Sensitivity

The same X-ray source as that used in the measurement of CTF was used in combination with green-sensitized MRE single-sided photographic material (manufactured by Eastman Kodak Co.). While the dose was adjusted by varying the distance between the combination and X-ray source, step exposure to light was conducted by a width of log E=0.15. After exposure to light, the photographic material was processed under the same conditions as those used in the measurement of CTF to obtain a measuring sample.

The density of the measuring sample was measured by visible light to obtain a characteristic curve. The reciprocal of exposure amount to X-rays providing a density of 1.8 is referred to herein as the sensitivity. The sensitivity is represented in terms of the relative sensitivity when the sensitivity of the intensifying screen HR-4 arranged on the back side is referred to as standard (100). The results obtained are shown in Table 1 below.

It can be seen from the results shown in Table 1 that Intensifying Screen A meets the conditions as set forth in the claims.

8. Evaluation of Combination of Photographic Material with Intensifying Screen (1) Sensitometry The photographic material Super HRS (commercially available, manufactured by Fuji Photo Film Co., Ltd.) was sandwiched between HR-3 and HR-4 screens (commercially available, manufactured by Fuji Photo Film Co., Ltd.), and the sandwich was subjected to step-exposure by a width of log E=0.15 while the exposure amount to X-rays was changed by a distance method. Further, a sheet of each of the Photographic Material 1, HR-8 screen (commercially available, manufactured by Fuji Photo Film Co., Ltd.) (back side) and Intensifying Screen A was used and arranged so that the photographic material was placed in front of the X-ray source, and the intensifying screen was placed on the back side of the photographic material. The combination was exposed to X-rays by using the above-described distance method. The same X-ray source as that used in the measurement of CTF was used, and processing was conducted in the same manner as in the measurement of CTF to obtain samples to be measured.

The density of each sample was measured by visible light to obtain a characteristic curve. The reciprocal of an exposure amount to X-rays providing a density of 1.8 is referred to as the sensitivity. The sensitivity in terms of the relative sensitivity is shown in Table 2 below. The characteristic curve is differentiated to obtain gamma vs log E. Point gamma of from a density of 1.6 to a density of 2.0 is determined from the gamma curve. The results obtained are shown in Table 2 below.

(2) Measurement of CTF

The combinations of the photographic materials with the intensifying screens which were used for sensitometry were used in the same manner as in sensitometry. Each combination was placed at a position which was 2 m away from the X-ray source, and a rectangular chart (made of molybdenum; thickness: 80 μm; spatial frequency: 0 line/mm to 10 lines/mm) was photographed. The same X-ray source as that used for sensitometry was used, and processing was conducted in the same manner as in sensitometry.

The exposure amount to X-rays was controlled by the exposure time so that the area which was not shielded by molybdenum had a density of 1.8.

Subsequently, the samples to be measured were operated by a microdensitometer. The aperture was 30 μm in the operation direction, and a slit of 500 μm in the direction perpendicular to the operation direction was used. Sampling was conducted at intervals of 30 μm to measure a density profile. The operation was repeated 20 times. The average was calculated and referred to as the base density profile for the calculation of CTF. The peak of the square wave for each frequency of the density profile was detected, and the density contrast for each frequency was calculated.

TABLE 1

| Intensifying Screen | Absorbed Dose of X-Rays | Sensitivity | CTF (1 line/mm) | CTF (3 lines/mm) |
|---|---|---|---|---|
| HR-3 (front side) | 18.2 | 48 | 0.890 | 0.660 |
| HR-3 (back side) | 18.2 | 48 | 0.889 | 0.660 |
| HR-4 (front side) | 22.3 | 89 | 0.850 | 0.510 |
| HR-4 (back side) | 23.1 | 100 | 0.850 | 0.506 |
| HR-8 (front side) | 31.3 | 155 | 0.775 | 0.340 |
| HR-8 (back side) | 32.2 | 170 | 0.763 | 0.336 |
| Intensifying Screen A | 32.8 | 200 | 0.869 | 0.494 |

The values obtained by making the measurement at a spatial frequency of 1 line/mm and at a spatial frequency of 3 lines/mm are shown in Table 2 below.

(3) Measurement of Noise Power Spectrum ($NPS_0$ (v))

The same X-ray source (80 KVp; 3 mm aluminum equivalent material; a filter of water of 7 cm in width being used) as that used in the measurement of MTF was used. The combination was placed at a position which was 2 m away from the X-ray tube, and exposure was conducted. The exposure amount was controlled so as to provide a density of 1.0 when the photographic material was developed, thereby preparing the $NPS_0$ measuring sample. The resulting sample was scanned with a microdensitometer. The aperture was 30 μm in the scanning direction, and a slit of 500 μm in the direction perpendicular to the scanning direction was used. Sampling was conducted at intervals of 20 μm to measure the density. There was conducted 8192 (points/line)×12 (lines) sampling. The results were divided into every 256 points to conduct FFT processing. The average number of times of FFT was 1320 times. The noise power spectrum was calculated from the results.

(4) Calculation of NEQ

NEQ was calculated from the following formula.

$$NEQ\ (v)=(\log_{10}e\times\gamma.MTF\ (v))^2/NPS_0\ (v)$$

The NEQ value in terms of the relative value is shown in Table 2 below when the NEQ value of the combination of HR-4/Super HRS is referred to as standard (100). The values at a spatial frequency of 1 line/mm and at a spatial frequency at 3 lines/mm as the representative values are shown in Table 2 below.

(5) Calculation of DQE

DQE was calculated from the following formula.

$$DQE\ (v)=NEQ\ (v)/Q$$

wherein Q is an incident X-ray quantum number; and NEQ (v) is the above-described relative value.

Since Q is in inverse proportion to the sensitivity of the composition, the above-described formula can be represented by the following formula.

$$\text{Relative DQE}\ (v)=\text{Relative NEQ}\times\text{Relative Sensitivity}$$

The relative DQE (v) value is determined from the above formula. The DQE value in terms of the relative value is shown in Table 2 below when the DQE value of the composition of HR-4/Super HRS is referred to as standard (100). The values obtained at a spatial frequency of 1 line/mm and at a spatial frequency of 3 lines/mm as the representative values are shown in Table 2 below.

(6) Evaluation of Image by Chest Phantom

The chest phantom (manufactured by Kyoto Kagaku K.K.) and an X-ray source of three-phase 12 pulse 100 KVp (an aluminum equivalent filter device of 3 mm in thickness) and having a focal spot size of 0.6 mm×0.6 mm were used. The phantom was placed at a distance of 140 cm. A scattering ray cut grid having a grid ratio of 8:1 was placed at the back of the phantom, the combination of the photographic material and the intensifying screen was placed at the back of the cut grid, and photographing was then conducted.

Processing was conducted by using the automatic processor FPM-5000, Developing Solution RD III and the above-described Fixing Solution F by 90 sec processing at 35° C. (development time being 25 sec) as in the measurement of the photographic characteristics.

A certain point of the lungs was fixed, and an exposure amount to X-rays was controlled by changing the exposure time so as to provide a density of 1.8. The finished chest phantom photograph was placed on a light table (i.e., a schankasten), and evaluation was visually made. The observability of the shadow of the blood vessels in the lungs was evaluated. The criterion is made such that a rating of A means very well observable, a rating of B means well observable, a rating C means somehow diagnosable, and a rating of D means not diagnosable. When there is a difference in superiority between the results having the same rating, a or z is attached to the end of the rating mark as represented by Aa (superior to other results of A) and Az (inferior to other results of A). The results obtained are shown in Table 2 below.

TABLE 2

| Composition No. | Intensifying Screen | Photographic Material | Sensitivity (D = 1.8) | Point Gamma at D = 1.6 to 2.0 | CTF 1 line/mm | CTF 3 lines/mm | NEQ 1 line/mm | NEQ 3 lines/mm | DQE 1 line/mm | DQE 3 lines/mm | Visual Evaluation of Chest (lung) |
|---|---|---|---|---|---|---|---|---|---|---|---|
| 1 (Comp. Ex.) | HR 3 | Super HRS | 55 | 2.7 to 3.2 | 0.82 | 0.51 | 131 | 162 | 72 | 89 | Ba |
| 2 (Comp. Ex.) | HR 4 | Super HRS | 100 | 2.8 to 3.2 | 0.72 | 0.37 | 100 | 100 | 100 | 100 | B |
| 3 (Comp. Ex.) | HR 8 (back side) | Photographic Material 1 | 55 | 2.75 to 3.2 | 0.80 | 0.32 | 215 | 121 | 118 | 66 | Ba |
| 4 (Invention) | A | Photographic Material 1 | 59 | 2.75 to 3.2 | 0.89 | 0.41 | 199 | 199 | 132 | 132 | Aa |

The following matters are apparent from the results shown in Table 2.

1. The sensitivity of the combination of the present invention is substantially equal to that of conventional high image-quality system Combination 1. The combination of the present invention has higher NEQ value than that of conventional combination, and the combination of the present invention has improved CTF on the low frequency side. Accordingly, the lung region is well observable.
2. The sensitivity of the combination of the present invention is lower by 40% than that of conventional standard system Combination 2. However, the combination of the present invention has improved CTF and NEQ. Particularly, the NEQ of the combination of the present invention is twice as high as that of conventional Combination 2. Accordingly, the lung region is well observable.

It is clearly seen from the above results that the present invention is effective.

EXAMPLE 2

Combination 4 used in Example 1 was processed in the following manner in place of the processing used in Example 1. The substantially same results obtained in Example 1 was obtained. Accordingly, it has been found that the present invention is effective even when the following rapid processing is carried out.

Processing

Automatic Processor

CEPROS-M (manufactured by Fuji Photo Film Co., Ltd.) wherein the driving motor and the gear were modified to speed up the conveying speed.

Concentrated Developer

| | |
|---|---|
| Potassium Hydroxide | 56.6 g |
| Sodium Sulfite | 200 g |
| Diethylenetriaminepentaacetic Acid | 6.7 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone | 22 g |
| 5-Methylbenzotriazole | 2 g |
| Processing Aid-I | 0.6 g |
| Water to make | 1 liter |
| (The pH was adjusted to 0.60) | |

Processing Aid-I

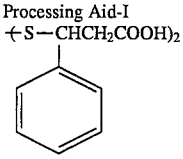

Concentrated Fixer

| | |
|---|---|
| Ammonium Thiosulfate | 560 g |
| Sodium Sulfite | 60 g |
| Disodium Ethylenediaminetetraacetate Dihydrate | 0.1 g |
| Sodium Hydroxide | 24 g |
| Water to make | 1 liter |
| (The pH was adjusted with acetic acid to 5.10) | |

When processing was started, each tank of the automatic processor was filled with the processing solution as described below.

Developing Tank:

333 ml of the above concentrated developer, 667 ml of water and 10 ml of a starter containing 2 g of potassium bromide and 1.8 g of acetic acid were added and the pH was adjusted to 10.25.

Fixing Tank:

200 ml of the above concentrated fixer and 800 ml of water were added.

Processing Speed:

adjusted so that a Dry to Dry time was 30 seconds.

Development Temperature: 35° C. (development time: 9.1 sec)

Fixing Temperature: 35° C. (fixing time: 7.1 sec)

Rinsing Temperature: 25° C. (rinsing time: 4.1 sec)

Drying Temperature: 55° C. (drying time: 9.4 sec)

Replenishment Rate:

Developing Solution:

20 ml/10×12 inches

Fixing Solution 20 ml/10×12 inches

While the invention has been described in detail and with reference to specific examples thereof, it will be apparent to one skilled in the art that various changes and modifications can be made therein without departing from the spirit and scope thereof.

What is claimed is:

1. A method for forming a radiological imagine using a silver halide photographic material comprising a transparent support having at least one silver halide emulsion layer on one side thereof and a backing layer on the opposite side to the silver halide emulsion layer, and a radiographic intensifying screen, wherein said radiographic intensifying screen has such characteristics that the absorbed dose is at least 25% of X-rays having an X-ray energy of 80 KVp, and the contrast transfer function (CTF) is at least 0.79 at a spatial frequency of 1 line/mm and at least 0.36 at a wherein said backing layer comprises a colored antihalation layer and said backing layer is coated with gelatin.

2. The method for forming a radiological image as claimed in claim 1, wherein said backing layer contains a water-soluble polymer.

3. The method for forming a radiological image as claimed in claim 2, wherein said water-soluble polymer is contained in an amount of at least 3% of the total weight of gelatin coated on the backing layer.

* * * * *

UNITED STATES PATENT AND TRADEMARK OFFICE

CERTIFICATE OF CORRECTION

PATENT NO. : 5,482,813

DATED : January 9, 1996

INVENTOR(S) : Ito Tadashi

It is certified that error appears in the above-indentified patent and that said Letters Patent is hereby corrected as shown below:

Column 28:

In claim 1, please amend the following as indicated in our Amendment Under 37 C.F.R. § 1.312 filed September 6, 1995:

1. A method for forming a radiological [imagine] image using a silver halide photographic material comprising a transparent support having at least one silver halide emulsion layer on one side thereof and a backing layer on the opposite side to the silver halide emulsion layer, and a radiographic intensifying screen, wherein said radiographic intensifying screen has such characteristics that the absorbed dose is at least 25% of X-rays having an X-ray energy of 80 KVp, and the contrast transfer function (CTF) is at least at 0.79 at a spatial frequency of 1 line/mm and at least 0.36 at a spatial frequency of 3 lines/mm, and wherein said backing layer comprises a colored antihalation layer and said backing layer is coated with gelatin.

Signed and Sealed this

Sixteenth Day of July, 1996

*Attest:*

Bruce Lehman

BRUCE LEHMAN

*Attesting Officer*

*Commissioner of Patents and Trademarks*